United States Patent [19]

Trell

[11] Patent Number: 4,851,688

[45] Date of Patent: Jul. 25, 1989

[54] PHYSICAL INSTRUMENT FOR DETERMINING ACCELERATIONS OF ELECTRONS

[76] Inventor: Erik Trell, Regementsgatan 6, S-211 42 Malmö , Sweden

[21] Appl. No.: 33,895

[22] Filed: Apr. 3, 1987

Related U.S. Application Data

[63] Continuation of Ser. No. 688,415, Jan. 2, 1985, abandoned.

[51] Int. Cl.[4] ..... H01T 49/44

[52] U.S. Cl. ..... 250/396 R; 328/235; 250/305

[58] Field of Search ..... 328/235; 313/359.1, 313/361.1; 250/396 R

[56] References Cited

U.S. PATENT DOCUMENTS

| | | | |
|---|---|---|---|
| 2,790,902 | 4/1957 | Wright | 328/235 |
| 2,885,552 | 5/1959 | Anderson | 328/235 |
| 3,412,337 | 11/1968 | Lothrop | 328/235 |

OTHER PUBLICATIONS

Donald et al., "A Superconducting Synchrotron Design Study at the Rutherford Laboratory, " Particle Accelerator Conference, Accelerator Eng. and Tech., Mar. 1971.

Guyon et al., "Design of a Synchrotron Radiation Facility for Orsay's ACO Storage Ring: LURE", Review of Scientific Inst., vol. 47, No. 11, Nov. 1976.

Miyahara et al., "SOR-RING: An Electron Storage Ring Dedicated to Spectroscopy," Particle Accelerators, vol. 7, No. 3, 1976.

Winick, "SSRL Past Experience, Present Development, Future Plans," IEEE Trans. on Nuclear Science, vol. NS-26, Jun. 1979.

Rakowsky, NBS-SURF II: A Small Versatile Synchrotron Light Source, IEEE Trans. on Nuc. Sci., vol. NS-28, No. 2 (Apr. 81).

*Primary Examiner*—Janice A. Howell

*Assistant Examiner*—Michael Aronoff

*Attorney, Agent, or Firm*—Berman, Aisenberg & Platt

[57] ABSTRACT

A physical instrument for electron-photon interactions and more particularly a physical instrument for production, recording, observation and transmission of temporo-spatially adjustable electron-photon interactions. The instrument comprises a ring-shaped vacuum tube with an electron injector, a linear accelerator, signal deflecting and collimating means operatively connected to the vacuum tube with free-flight intervals of the tube between adjacent means, interaction recording components associated with the tube in the free-flight intervals thereof, and a computer processing unit with a display, which is operatively connected to the accelerator and the interaction recording components.

5 Claims, 3 Drawing Sheets

FIG. 1
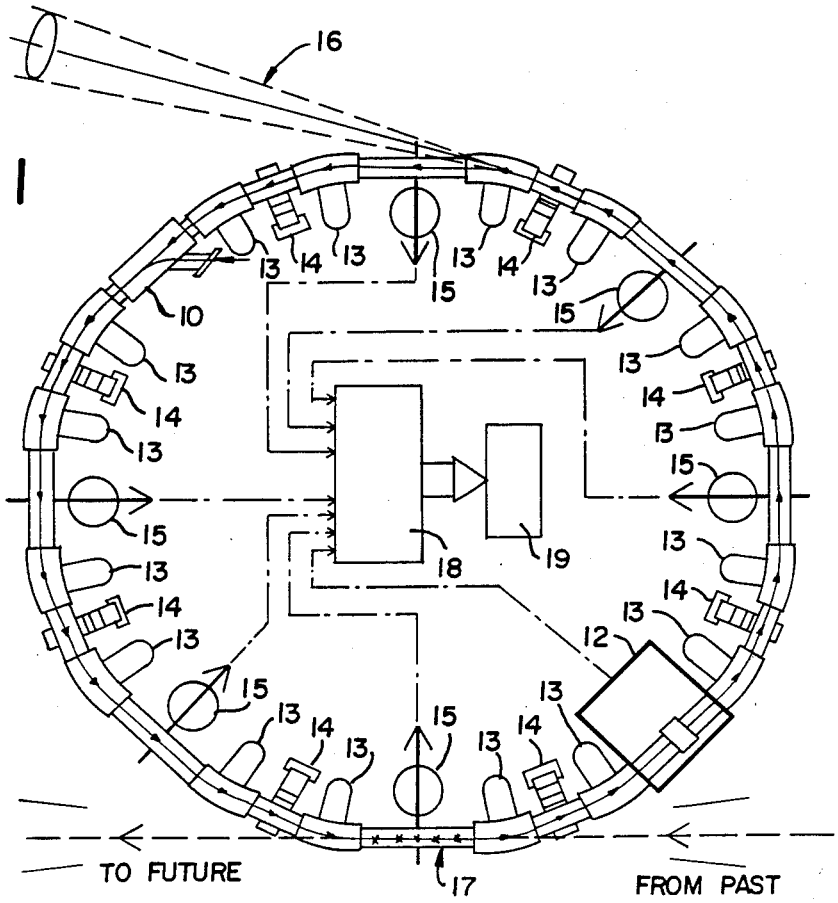
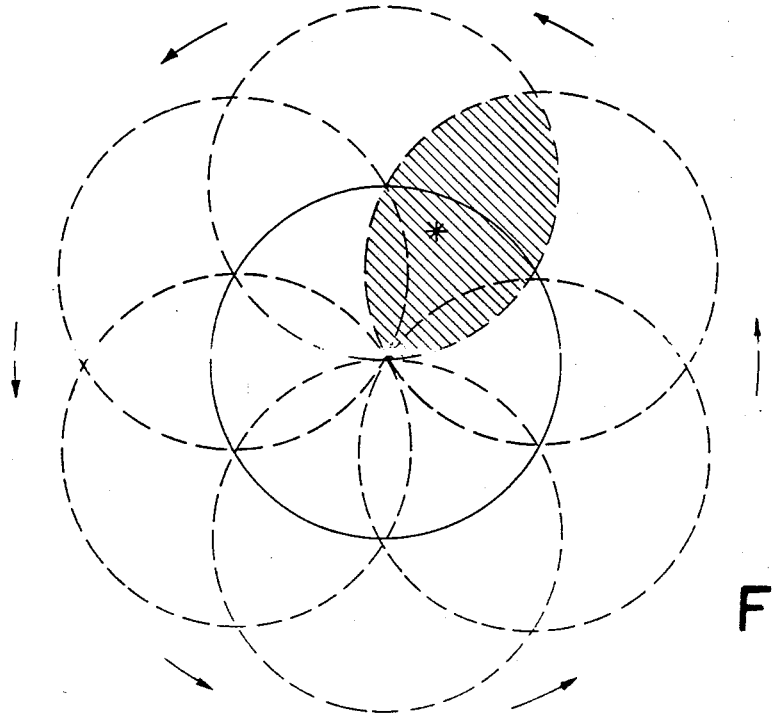
FIG. 2

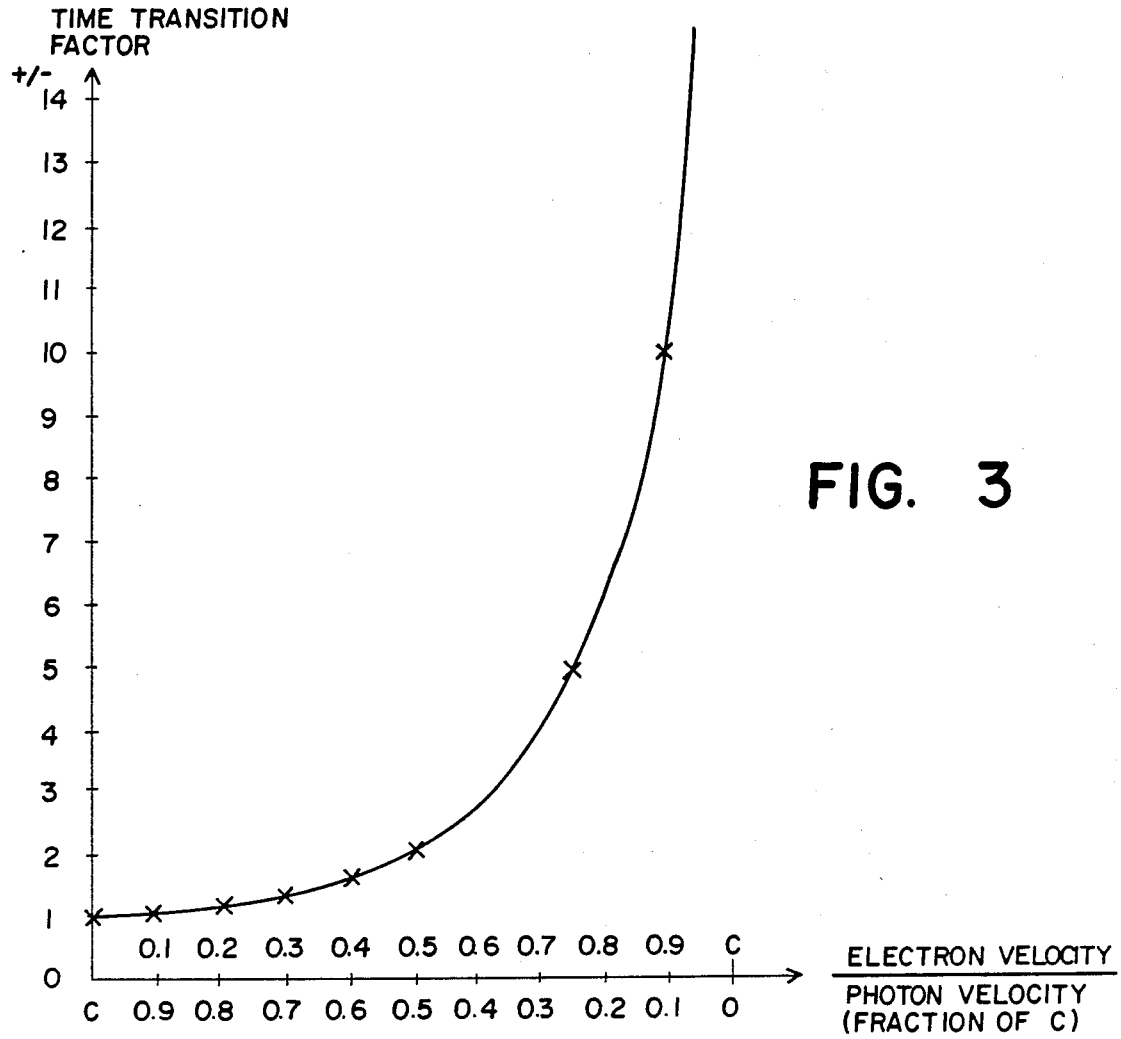
FIG. 3
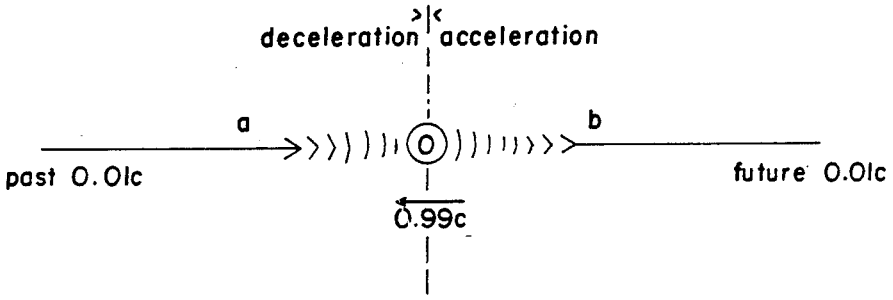
FIG. 4a-b

PHYSICAL INSTRUMENT FOR DETERMINING ACCELERATIONS OF ELECTRONS

This application is a continuation of Ser. No. 688,415, filed Jan. 2, 1985, now abandoned.

This invention relates to a physical instrument for production, recording, observation and transmission of temporo-spatially adjustable electron-photon interactions.

It is currently believed that the relativistic conditions of a rotating black hole event horizon are associated with an actual temporo-spatial matter-radiation interaction transition leading to connections with other regions of space-time. Space-time, in turn, is generally considered as an established, fixed and complete entity or "block universe", which however may contain a multitude of equally ready, parallel or alternative realizations. It has been seriously proposed that one means of producing the aforementioned temporo-spatial transitions or shifts between different regions of space-time is to travel into and through a stellar black hole object. However, the changes of getting away unhurt or sending signals back to any present observator frame from such a passage, or in other ways control and adjust it, seem to be very small, so that it is unlikely that this method will be feasible or performed. Also the possibilities of sending an unmanned observation vehicle through the event horizon and of communicating with it after the temporo-spatial transition seem very minute due to the extreme and physically destructive gravitational forces which are also associated with currently known stellar black hole objects.

It is however evident that the expressed scientific opinion today is that the physical laws and conditions prevailing in bloc universe comply with the actual existence of matter-radiation interactional transitions in space-time, and that a concrete mechanism by which such shifts in fact take place is realized and performed through rotations with speed close to c (c=velocity of light) of rotating black hole event horizons. It should therefore be possible to recreate and construct the physical mechanism and properties of the temporo-spatial matter-radiation interaction shift of a rotating black hole event horizon without including its destructive gravitational processes.

It is the object of the invention to provide a physical instrument, according to which the interaction transition is manufactured by an adjustable and sufficiently rapidly rotating matter component and detected and recorded by an observatorial processing component of the instrument. Such an instrument will then, according to the existing physical laws, concretely perform and display temporo-spatial matter-radiation transitions corresponding to a rotating event horizon by carrying said principle with itself and thus avoiding the necessity of travelling into the gravitational trap characterizing stellar black holes.

According to the invention, said object is achieved by an instrument comprisinng a ring-shaped vacuum tube, an electron injector for supplying electrons to the tube, a linear accelelrator for accelerating electrons supplied to the tube, several deflecting and collimating means operatively connected to the vacuum tube with free-flight intervals of the tube between adjacent means, interaction recording components associated with the tube in said free-flight intervals thereof, a computer processing unit operatively connected to said accelerator and said interaction recordingn components, and a display connected to said computer processing unit.

In order to explain the invention in more detail, embodiments thereof will be described below with reference to the accompanying drawings in which FIG. 1 is a diagrammatic plan view of an instrument according to the invention constructed as a modified electron accelerator of the synchrotron/electron storage ring type;

FIG. 2 is a diagram illustrating the rotation of the electron path/accelerator tube around the propagation axis;

FIG. 3 is ag raph of the exponential time displacement factor relative to the electron speed of rectilinear electron-photon interactions in the instrument of the invention;

FIG. 4 illustrates the movement of an electron and the interaction between the electron and a photon;

Figure 5:
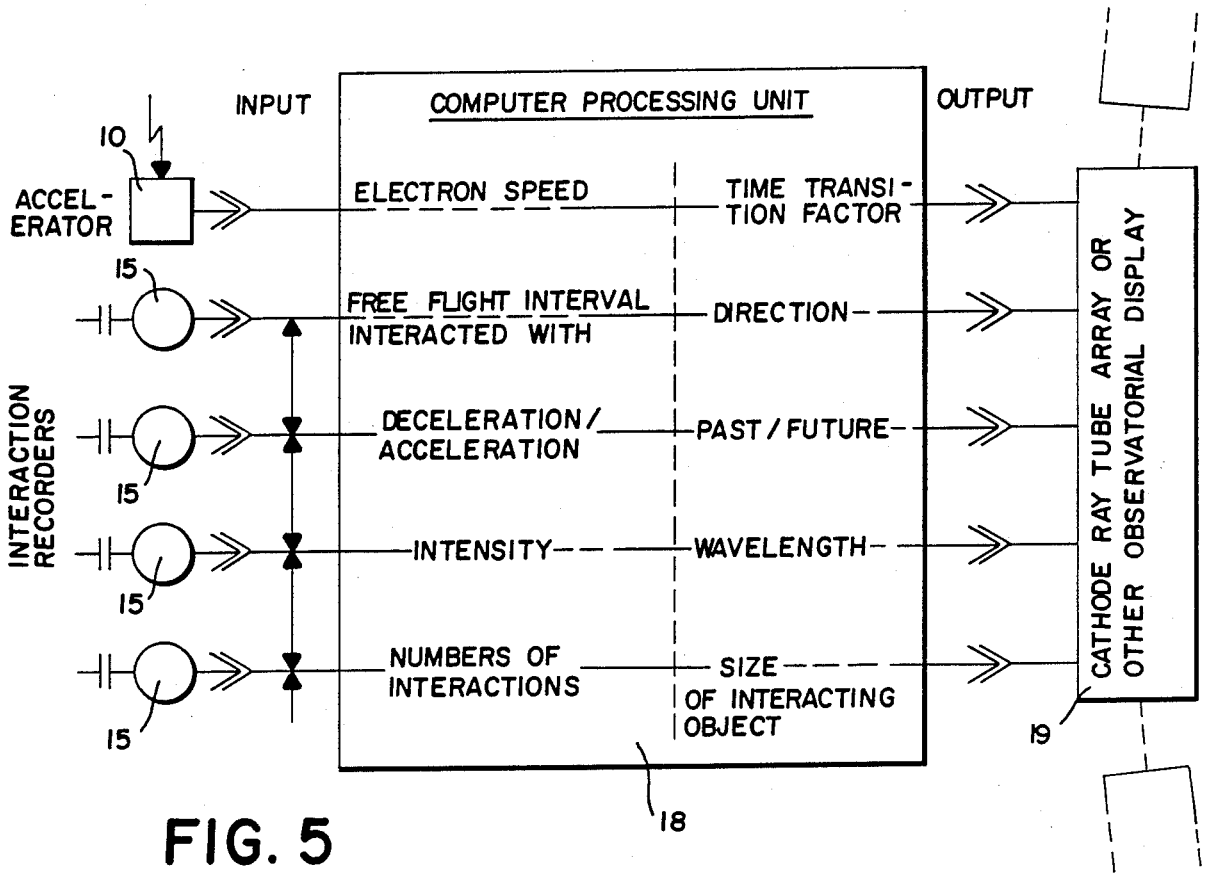
FIG. 5 is a diagrammatic outline of the computer processing unit of the instrument.

The law which governs all electron-photon interactions is the absolute spped c of the photons in relation to the electrons. In ordinary perceptual observations the mutual, emitting and receiving aspects of the interaction arise in composite systems, of which both have their own resting reference frames. In the observatorial frame this will impose an adjustment of the apparent object velocity according to the well-known relativistic correction formula:

$$V = \frac{v_1 + v_2}{1 + (v_1 v_2)/c^2}$$

However, in each separate electron-photon absorption or emission per se the law must apply directly, in which case it imposes a straighforward vector addition of the velocity contributions of the single photon and single electron, respectively, to the total velocity c of the isolated interaction process. The idea of the present device is to utilize this primary velocity vector addition by direct interactions between a system of single high-speed electrons and equally much slower virtual photons, i.e. from correspondingly shifted regions of the surrounding block universe.

One practicable way of achieving and manufacturing said high-speed electrons is a ring-formed particle accelerator of the synchrotron type, modified according to the new and special purposes and requirements of the present invention, and furthermore supplied and combined with interaction detecting, recording, observation and transmission devices into the here contrived new and special instrument assembly.

FIG. 1, to which reference is made, shows a device for bringing and keeping electrons in an orbitally accelerated path at regulated high speeds, up to very close to c, and for recording radiative interactions with other regions of space-time of these electrons at repeated free-flight intervals of their stepwise orbital path.

The device is a modified electron accelerator of the synchrotron/electron storage ring type. There is provided for the injection of the electrons an electron injector 10 at one (or multiple) site from the interior (or exterior) of a mobile or stationary carrier or other framing of the instrument, into a toroidal vacuum tube 11, the vacuum of which can be produced by a vacuum pump mechanism (not illustrated).

In the ring-formed tube, the electrons nare linearly accelerated to and maintained at their desired speeds by a steerable energy supply in a radio-frequency resonant cavity 12 or other linear accelerator component of the instrument.

The electrons are orbitally accelerated (=deflected) into the stepwise ring-formed path by electromagnets 13 at regularly spaced intervals of the circumference of the tube. The power supply of these magnets, whose number may vary, is coordinated with the electron speed, i.e. the strength applied to the linear accelerator component of the instrument. The orbital deflection magnets are combined with a focussing magnet (magnet lens or collimator) 14, which keeps the electrons in a narrow and coordinated beam-like trajectory.

Between the deflecting and focusing magnets 13 and 14, the free-flight electron path and corresponding vacuum tube configuration are rectilinear. In all these intervals, except the sites of the electron injection and linear accelerator components, the electron motion is non-accelerated. In these repeated free-flight intervals, interaction recording components 15 are placed. It is proposed that radiative interactions in the visible and lower as well as higher radio-frequency wavelengths will be oriented along the same interaction cone relative to the electron direction in the free-flight intervals, as teh synchrotron radiation when the electrons are orbitally accelerated under the deflecting magnets as shown at 16, where the direction and distribution of synchronous radiation from deflected high-speed electrons are indicated. The higher the speed of the electrons, the more collimated along the electron propagation axis is this cone, and thus gives the spatial location and direction of the interaction source as indicated at 17, where the spatio-temporal direction of electron-photon interactions in free-flight intervals is illustrated (same spread as in sychrotronous radiation cones of electrons with the same speed).

In the non-accelerated and nnon-deflected free-flight intervals of the high-speed electrons, only photons equally much slower in comparison with the speed of light than the electrons can interact directly with them within these narrow cones. Like all electron-photon interactions they must produce corresponding decelerations/accelerations of the electrons. These processes can be recorded as the resulting disturbances in the otherwise homogeneous electron current.

There are several possible methods for measuring, over the entire or at any part of the free-flight intervals, these changes in the electric field generated around and by the electron current. Here a sensitive particle-counter or electrostatic cathode-ray oscilloscope/oscillograph is proposed, which can record and indicate very small changes and which can be facing the interior aspect of the rectilinear free-flight segments. In this way, the electric current pattern can be measured both in absolute terms and relative to the recordings in the other free-flight intervals of the ring. By rotation around the vertical axis of the ring, these straight lines can cover the full horizontal circumference of the instrument. By small rotations of the whole vacuum tube (or its carrier) around the electron propagation axis, the corresponding direction uncertainty due to the cross-section of the interaction cone can also be solved.

The electron-photon interactions can be of two kinds, absorption and emission. In the present instrument, photon absorption in the free-flight electron intervals represents an interaction with a past region of space-time and is expressed and can be measured if it occurs in sufficiently number of the electrons as a corresponding deceleration of their current under the electric field recorder. An emission process in the interaction cone direction represents a communication with a future region and is expressed and measured as an nacceleration. The order of the deceleration/acceleration, which can be obtained from teh recorder, corresponds to the intensity of the source, and the number of events to the size/density of this.

The instrument may be of varying size. For most practical purposes a diameter of the electron orbital ring in the order of 15–100 meters or more will be suitable.

It is envisaged that the electrons circulate in a toroidal vacuum tube, which may be transparent or optically dense and in which the vacuum can be induced and maintained by a pump mechanism or (e.g. out in space) automatically. The regularly spaced electromagnets provide forceful electromagnetic fields which accelerate the electrons into a stepwise orbital path. Between the deflecting magnets, the electron trajectory is non-accelerated and rectilinear. Some further and for the present invention essential and suitable features of these stepwise orbitally deflected electrons are:

(a) The accelerated electrons gather in pulses. Thus, a rotating "front" or "horizon" of many assembled electrons is established in which several separate and isolated direct electron-photon interactions may occur together and thus by synchronized and multiplied to an order sufficient to record.

(b) In the accelerator, the electrons can be brought to a wide range of predetermined speeds, up to very close to c, by one or more resonance cavity radio-frequency energy supplies. Thus, the velocity of the electrons can be set very accurately by a simple energy regulator, and maintained as in an ordinary electron storage ring.

(c) Each time the electrons are accelerlated under the deflecting magnets, so-called synchrotronous radiation is emitted. This is thus not the type of photon-electron interactions envisaged in the present contrivance, but a simultaneous radiation associated with the deflection of the electrons in a similar way as the emission of photons in the Bohr orbital model of the hydrogen spectroscopy. However, one important characteristic of the synchrotronous radiation is its spatial orientation, which is successively more collimated along the non-accelerated electron propagation axis the closer to the electron speed is as indicated at 16. It is reasonable that other radiative interactions must have the same orientation, which is thus dependent upon and derivable from the direction and speed of the electrons at each moment of their path. The only uncertainty is the successively increasing cross section of the radiation cone along the electron path with lower propagation velocities, but since the size of this cross section can always be determined from aid velocity, the exact direction of the interaction can be solved, e.g. by rotating the electron path or the storage ring or its carrier around the electron propagation axis, over the same cross-sectional area, as is illustrated in FIG. 2.

In conclusion, a particle accelerator of the synchrotron type, modified and adjusted to the special requirements and properties of the present invention, provides a practicable mechanism for keeping electrons in synchronized motion with a wide range of steerable velocities, even approaching c, where direct electron-photon interactions with correspondingly slower virtual photons must emanate from other temporo-spatial regions of Universe and be directed along the interactions cones known and demonstrated in relation to the electron motion by the synchrotronous radiation.

Accordingly, as shown at 17, the closer to c the speed of the electrons is, the more parallel to their mainstream orbital motion must the orientation of the interacting virtual photons be, and the exact localization of the source of the virtual photons can be derived also at slower electron speeds, e.g. by rotation of the electron path/accelerator tube around the propagation axis as described earlier with reference to FIG. 2. Thus, since the direction ad velocity of each electron is known at any point of its trajectory, the velocity of the interacting photon in relation to the electron so that their speeds add to c can also be simply calculated. This speed furthermore gives the temporal transition factor of the interaction. If, in the case of a head-on interaction, the speed of the electron is ½ c, the speed of the virtual photon is also ½ c, and if the source of the interaction is $9.5 \cdot 10^{12}$ km away (=one light-year in a resting earthern frame), the time transition factor must be 2; i.e. the virtual photons stem from a point two years ago in the terrestial reference in that space-time coordinate. But if the electron speed is 0.99 c, the same factor will be 100 and the temporal transition 100 years; and if the electron speed is 0.999999 c, the factor is 1,000,000 and the time displacement over the same distance 1,000,000 years. Henceforth, these examples show that the temporal transitions induced by changes in the electron speed are exponential. At low electron speeds, large velocity changes in the order of 0.2–0.1 c impose relatively unremarkable temporal displacements, but with higher electron velocities small differences in the speed induce gradually larger temporal shifts. This is illustrated by the graph of FIG. 3.

In consequence, by steering, controlling and knowing the speed, location and mainstream direction of the electrons at any point of their path, the direction and time displacement factor of the virtual photon source can be simply computed. However, there are two complementary forms of electron-photon interactions, i.e. absorption and emission. Both of these may equally probably take place with other factually existing regions of space-time in relation to the electron. With reference to FIG. 4, if, for instance, a virtual photon meets an electron moving in the forward direction with speed 0.99 c, the speed of the photon must be 0.01 c and it will be absorbed by the electron and emanate from a past region of space-time in relation to the the observatory reference frame, left side of FIG. 4. But if the electron emits a virtual photon this has to leave the electron from its backward (or possibly forward) aspect with speed 0.01 c and interact with a corresponding future region in the opposite temporal direction of space-time, right side of FIG. 4. The emission of a virtual photon is not more "active" than the absorption of a virtual photon, but will occur equally probably if there is a future region of space-time in which the relation to the rapidly moving electron is such that the conditions of this virtual interactions are fulfilled.

The time displacement factor will be of exactly the same order but directed to the future instead of to the past. However, the interesting measurable present-time effect of the absorption/past and emission/future interactions, respectively, is that the former will be accompanied by a deceleration of the electrons interacted with, while the latter will be accompanied by an interacted with, while the latter will be accompanied by an acceleration. By measuring the presence, magnitude, and numbers of such decelerations and/or accelerations, these interactions and their further important properties can be recorded.

The magnitude of the deceleration/acceleration is proportionate to the intensity/wavelength of the photon source, while the number of interaction events, i.e. quantity of electrons affected by it in each pulse, must be proportionate to its density/size. Henceforth, both direction, time displacement factor, past or future nature, intensity and size of the radiative object can easily be obtained from computation of measurable present-time characteristics of the mainstream electron pulses in the acceleration ring. For these measurements, it is suitable to utilize the free-flight intervals of the electron path between the deflecting magnets. A device is incorporated in the instrument, for detecting and recording the occurrence and nature of radiative interactions with the travelling electrons in these repeated intervals of their trajectory. This device is shown at 18 in FIG. 1 and comprises a computer processing unit which is operatively connected to the accelerator 10 and the interaction recorders 15 as indicated in FIG. 1. The output of the computer is connected to a cathode-ray tube array or other observatorial display 19. The computer processing unit and the parameters processed therein are more clearly shown in FIG. 5.

The concealed nature of the aforementioend radiative interactions of rapidly moving electrons is that they occur with correspondingly shifted other regions of space-time and are thus not spontaneously observed ina resting earthern frame of reference. The only simultaneous radiative interaction of the electrons that is noticed in this situation is the synchrotron radiation associated with their orbital acceleration.

Interactions with other regions of space-time must be accomplished by virtual photons which can be recorded only by their effects upon the fast electrons with which they primarily interact; i.e. a deceleration/acceleration along the interaction direction axis, reflecting an actual absorption/emission process. It was proposed already by Maxwell that photons are transverse undulations from changing electric currents, viz, in the case of an isolated electron-photon process occurring along with the electron path direction, analogous to longitudinal waves transverse t the axis of deceleration/acceleration of the electron. In rapid electrons with a known and narrow trajectory along the mainstream propagation orientation, photon interactions must therefore be more and more head-on/head-off in relation to the electron motion the higher the velocity of the electrons is. The only way to measure such electron-photon absorption or emission processes in teh free-flying rectilinear intervals between the deflecting accelerator magnets is by sensing and registering the corresponding present-time deceleration/acceleration of the electrons affected by the interaction. If experienced by a sufficiently large fraction of the electrons, these processes can be detected by a particle or electrostatic recorder spanned over the free-flight intervals of the electron path in the accelerator ring.

In principle, pulses of undisturbedly free-flying electrons passing through such a device would cause no deviations from the expected homogeneous pattern, but a sizeable number of decelerations and/or accelerations will induce corresponding perturbances in the electron current, which can be recorded as to type (deceleration or acceleration), intensity and quantity of events. Such particle or electrostatic field recorders can be spanned across most free-flight intervals of the electron storage ring between the deflecting magnets and thus cover segments over most of the accelerator circumference.

The velocity and mainstream orientation of each electron pulse in the respective rectilinear free-flight intervals are known and adjustable, and hence the direction of the radiative source can easily be computed from these steerable and controllable factors. Also the information on past/future nature, intensity and quantitative magnitude of the source as derived from the electrostatical field detection component of the instrument can be directly transferred to and simply calculated by the same computer as diagrammaically shown in FIG. 5. Thus, exact data on direction, sign and size of time displacement factor, wavelength/intensity and magnitude of the interacting object (which over large space-time distances in most cases is a star or corresponding sizeable stellar matter) can be immediately calculated and processed by a computer component of the contrivance.

The present invention constitutes a new and unique combination and assembly of practicable instrument components for the accomplishment and maintenance of adjustable and controllably rapid electron motions and for the earlier not realizled functions of detecting, recording and computing decelerative or accelerative processes due to interactions with virtual photons from other regions of space-time of these electrons at repeated free-flying intervals of their path. Accommodated with a computer unit, this instrument henceforth provides the not previously described composite purposes and techniques of registration and detailed calculation of temporo-spatial electron-photon interaction shifts analogous to and by the same mechanism as a rotating black hole. The computer input and transactions of the data, i.e. direction, temporal displacement, intensity and size of the object, are well suited for on-line computer processing and output to an optical or other display, e.g. as a visual image on a cathode-ray screen supplied with the necessary space-time corrdinates and other useful reference and frame indicators.

Figure 6:
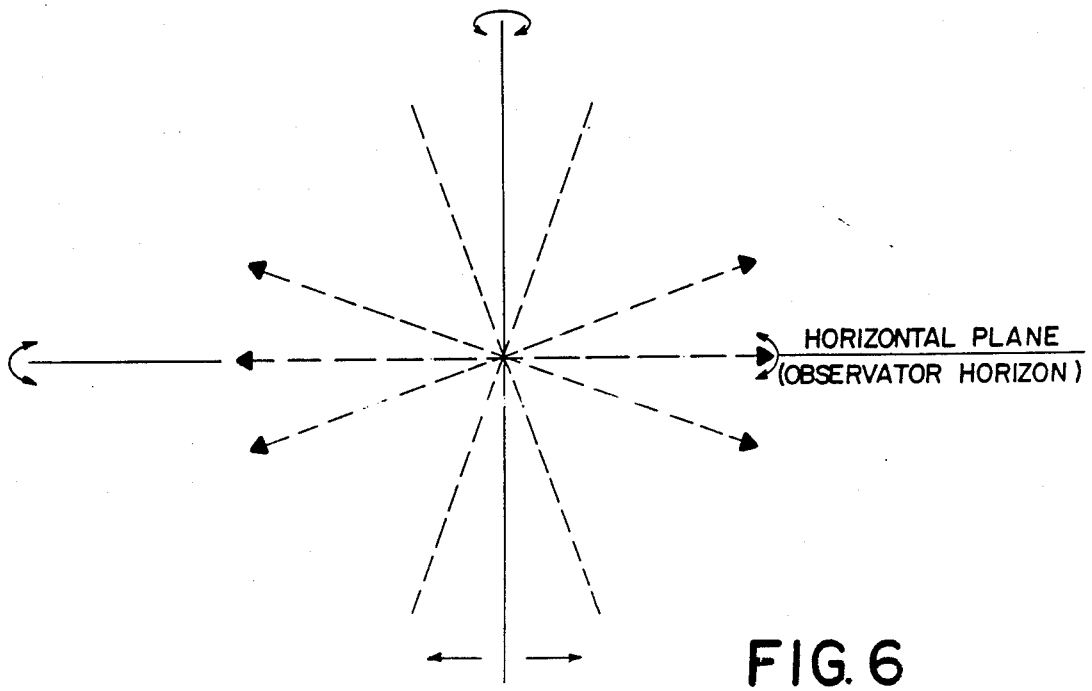
FIG. 6 is a diagram illustrating the mobility of the storage ring and/or its carrier in the instrument.

The assemblied instrument can be accommodated for various purposes and vehicles, e.g. as a fixed earth-or satellite-bound temporo-spatial telescope station or around the outer circumference of a mobile space-craft, in which case a visual cathode-ray display system can be arranged continuously or interruptedly along the internal aspect of this electron accelerator ring or observatorial "horizon". This will then cover all spatial direction due to the steerable orientation in and around the vertical plane of the mobile carrier of the instrument (FIG. 6).

It is also possible to process analogous auditory, radar and/or other communication principles from the computer input and transactions.

Through inversion, the same principles and mechanisms can be utilized not only for receiving but also for transmitting and sending analogous impulses and signals to arbitrarily defined future or past regions of space-time, viz. by the controlled induction of rectilinear accelerations or decelerations of the electron pulses in the respective free-flight intervals of their trajectory.

I claim:

1. A physical instrument for recording and observing a group of electrons in a charged particle accelerator, said accelerator comprising a ring shaped vacuum tube, a linear accelerator for accelerating electrons tube, a linear accelerator foro accelerating electrons supplied to the tube, signal deflecting and collimating means operatively connected to the vacuum tube with free-flight intervals of the tube between adjacent deflecting and collimating means, said instrument comprising detection means for determining the magnitude and quantity of accelerations or decelerations of the group of electrons circulating in said vacuum tube, said detection means being located in said free-flight intervals, a computer processing unit operatively connected to said accelerator and said detection means, and a display connected to said computer processing unit.

2. The instrument as claimed in claim 1 wherein the vacuum tube is mounted for universal adjustment.

3. The instrument of claim 1 wherein said detection means is a particle detector.

4. The instrument of claim 1 wherein said detection means is an electrostatic recorder.

5. A method for recording and observing a group of electrons comprising providing a charged particle accelerator, said accelerator comprising a ring-shaped vacuum tube, an electron injector for supplying electrons to the tube, signal deflecting and collimating means connected to the tube and defining free-flight intervals between adjacent said deflecting and collimating means, and determining the magnitude and quantity of accelerations or decelerations of the group of electrons circulating in said tube.

* * * * *